United States Patent [19]

Jansson

[11] 4,155,542

[45] May 22, 1979

[54] DEVICE FOR HOLDING WORKPIECES

[76] Inventor: Sixten V. Jansson, Spantgatan 16, 951 56 Luleå, Sweden

[21] Appl. No.: 919,774

[22] Filed: Jun. 28, 1978

[30] Foreign Application Priority Data

Jun. 30, 1977 [SE] Sweden ..... 7707562

[51] Int. Cl.[2] ..... B23Q 3/02

[52] U.S. Cl. ..... 269/94; 269/239

[58] Field of Search ..... 269/91, 93, 94, 239, 269/210, 130–132

[56] References Cited

U.S. PATENT DOCUMENTS

| | | | |
|---|---|---|---|
| 1,072,363 | 9/1913 | Roberts | 269/94 |
| 2,471,726 | 5/1949 | Coffing | 269/239 |
| 3,767,182 | 10/1973 | Badovick | 269/94 |
| 4,011,979 | 3/1977 | Hagen et al. | 269/132 |

*Primary Examiner*—Robert C. Watson

*Attorney, Agent, or Firm*—Hammond & Littell

[57] ABSTRACT

This invention relates to a system for releaseably securing workpieces to a worktable, including a pressure element and/or a draw element. Both said elements have means for coarse- and fine adjustment. According to the invention the draw element is flexible and consists of a link chain, the coarse adjustment means consists of at least one bracket for engagement with at least one chain link, said bracket having means for direct or indirect engagement with a groove of a worktable and that the fine adjustment means consists of a member wherein a threaded bar may be screwed. Said member and said bar are arranged to be attached to an abutment respectively to a bracket and to said chain.

3 Claims, 6 Drawing Figures

DEVICE FOR HOLDING WORKPIECES

The present invention relates to the holding and clamping of workpieces preparatory to a machine operation or the like.

Independent of the shape of the workpiece clamping means must be used but very often—especially when large workpieces are to be secured—it is required to use block up means in combination with clamping means.

As blocking up means pieces of wood are used because of their convenience. For this purpose hydraulic jacks are available, but they are often too weak and have too small a range, or, if the range is sufficient, the handling is heavy and difficult.

As clamping means only threaded carriage beams are used in the workshops. Such carriage beams often have to be jointed because the threads are rapidly worn out and new carriage beams must be obtained. Moreover a number of different length of carriage beams are required for adaption to the various shapes and size of the workpieces. Another essential drawback with all known types of block up means and clamping means is the circumstantial handling. It occurs often that the time for arranging the clamping means exceeds the time for the machining/repair of the workpiece.

SUMMARY OF THE INVENTION

It is among the objects of the invention to provide an improved system for temporarily holding workpieces that is relatively cheep to obtain, that considerably reduces the time to secure the workpiece to a worktable.

This and other objects are accomplished thereby that the draw element is flexible and consists of a link chain, that the coarse adjustment means consists of at least one bracket for engagement with at least one chain link, said bracket having means for direct or indirect engagement with a groove of a worktable and that the fine adjustment means consists of a member, wherein a threaded bar may be screwed, whereby said member and said bar are arranged to be attached to an abutment respectively to a bracket and to said chain.

DESCRIPTION OF THE PREFERRED EMBODIMENT

Figure 1:
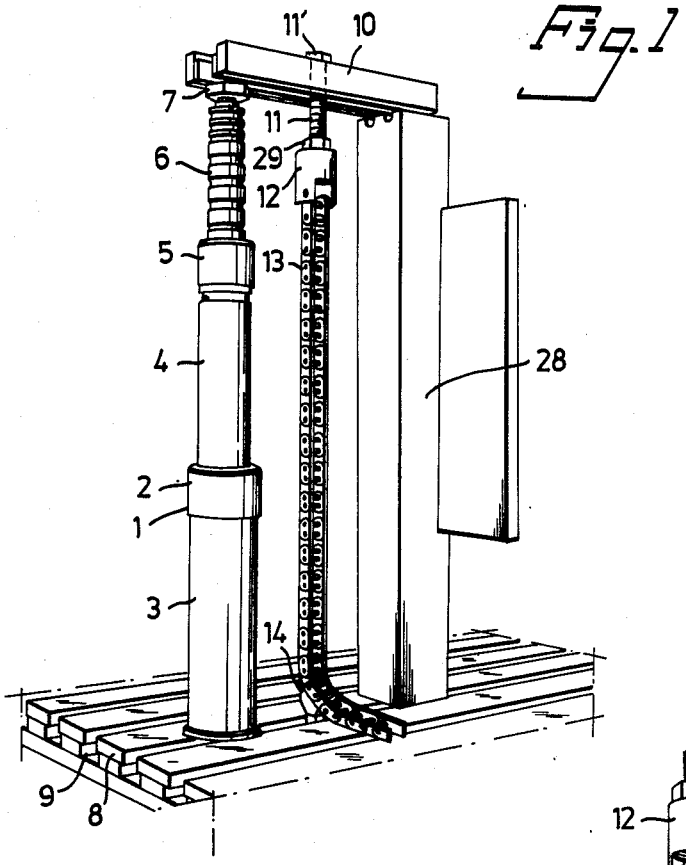
FIG. 1 is a perspective view showing a clamping element, a block up element and a workpiece secured thereto

Referring more particularly to the drawings and initially to FIG. 1 a system according to the invention contains two main elements, wiz. a telescopic support means 1 and a flexible clamping chain 13. An elongated workpiece 28, presumed to be machining, is shown secured to a conventional worktable 8 by means of the system according to the invention. A yoke 10 is detachably arranged so, that one end rests on the top of the vertical workpiece 28 and the opposite end rests freely on the top of the vertical support 1.

On a suitable place, in the present embodiment approximately midway between the workpiece 28 and the support 1, the clamping chain 13 is attached to the yoke 10 by means of a threaded bar 11 extending through said yoke. Said threaded bar 11 is preferably connected to one end of the chain 13 by means of a preferably flexible chain head 12, wherein said bar is screwed and locked by a threaded nut 29. The chain 13 is clamped by tightening a nut 11' screwed on to the free end of the bar 11. The opposite end of the chain or a suitable place along the length of the chain is detachably connected to a chain end bracket 14 which in turn is detachably attached to a groove 9 of the worktable 8. Said groove may be a common dovetail slot. The support 1 rests on the upper side of the worktable 1. The chain 13 is shown in a larger scale in FIG. 2.

Figure 2:
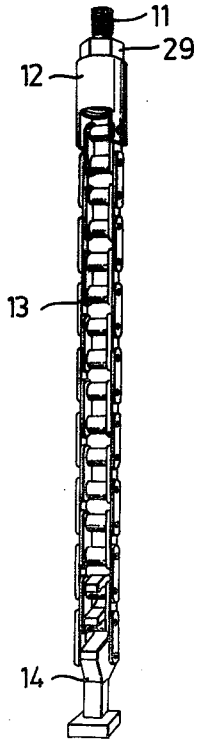
FIG. 2 is a perspective view showing a clamp chain
Figure 4:
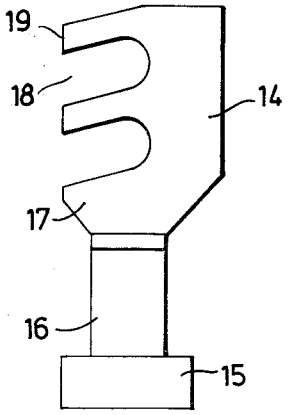
FIG. 4 is a side view of an end bracket for the chain

The chain end bracket 14 is shown in detail in FIG. 4 and includes a lower part 15 for engagement in a slot 9 in the worktable 8 and a upper part 17 connected to the lower part 15 via an intermediate part 16. The upper part is provided with at least one preferably two recesses 18 forming slightly downwardly inclined spaced projections 19. The size of the recesses is choosen as to provide engagement in the links of the chain 13, which is illustrated in FIG. 2.

Figure 3:
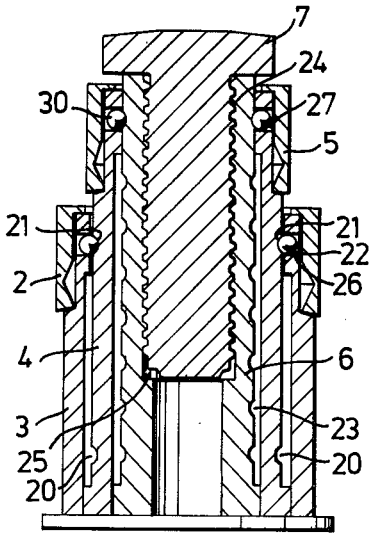
FIG. 3 is a section view of a telescopic support device

The telescopic support 1 is shown in section in FIG. 3 and includes a lock cylinder 6 with circumference ball grooves 23 having a certain mutual graduation. An inner sleeve 4 encircles the cylinder 6. Said cylinder 6 has at the top a threaded boring 25, wherein a adjusting screw 7 with outer threads 24 is fitted. Said ball groove graduation correspond to the fine adjustment range of the screw 7. The inner sleeve 4 has at the top a circumference series of ball recesses 27 for balls 30 arranged to engage said grooves 23. The cylinder 6 may—from the position shown in FIG. 3—be manually raised stepwise corresponding to the graduation of the ball grooves 23 and within each step fine adjustment of the effective height of the support device may be obtained by means of the screw 7. The locking of the balls 30 in desired groove 23 is obtained by means of a clamping ring 5 arranged on the upper end of the sleeve 4. Said sleeve 4 has on its outer side an upper ball groove 21 and a lower ball groove 20 to cooperate with a series of clamping balls 22 resting in ball recesses 26 of an outer sleeve 3. The sleeve 4 is shown in its lower position with the balls 22 of a clamping ring 2 locked in the upper ball groove 21. It will be understood that the sleeve 4 may be moved upwards relatively to sleeve 3 whereby the balls finally are locked in the lower ballgroove 20.

The operation of the system according to the invention is probably obvious from what is described above in connection with the drawings, especially FIG. 1 and the embodiment shown in said figure, a workpiece 28 essentially of rectangular form and blocked up and secured to a worktable 8 by means of the telescopic support 1 with mechanical locking (ball locking) and a clamping element in the form of a chain 13 and its lower part clamped to the worktable 8 and the upper end engaging a yoke 10 resting on the upper ends of the support 1 and the workpiece 28. The height of the support 1 is coarse adjusted by means of the sleeves 3 and 4 and the cylinder 6 and fine adjusted by the screw 7. The screw bar 11 then is screwed into a threaded boring in the yoke 10 and the lower bracket 14 engages a groove 9 in the worktable 8 and the chain 13. By tightening the nut 11' the workpiece 28 is firmly secured and ready for machining.

However, it is obvious that the elements included in the improved system, that is the support 1 and the clamping chain 13, can be used independently of each other in such case, where the workpiece is of such shape that either blocking up or clamping is required. It is also obvious that one or more supports according to the invention can be used independent of the chain 13. Should the workpiece have a round shape, the chain 13 can be used without the support 1 by clamping the chain around the workpiece and attaching the ends of the chain to the worktable by means of end brackets 14 and a cooperating tightening screw (not shown) analogous to the member 12 and the bar 11 for fine adjustment of the chain.

The support 1 and the clamping chain 13 have analogous means for height- and length adjustment. The support is coarse adjusted by telescopic displacement of the cylinder 6 stepwise in correspondence to the graduation for the grooves 23 and the chain 13 is stepwise coarse adjusted by connecting the projections 19 of the end bracket 14 to suitable chain links. Fine adjustment of the support 1 within a coarse chain link step is obtained by fine adjustment screw 7 and fine adjustment of the chain 13 within a coarse chain link step is obtained by tightening the bar 11 more or less deeply into the member 12.

Figure 5:
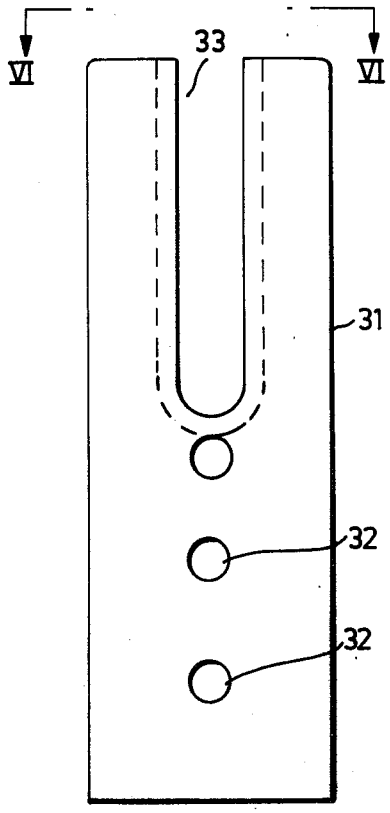
FIGS. 5 and 6 show complementary means.
Figure 6:
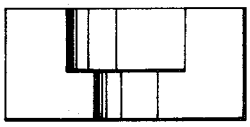

As indicated above the shape and the size of the workpieces can vary considerably. Irrespective of shape and size it is important that the component force of the clamping element 13 is vertical or essentially vertical. In such case that the shape of the workpiece does not permit that the cooperation of the bracket 14 with a groove 9 in the worktable 8 causes a vertical component force, the member 31 according to FIGS. 5 and 6 may be used. Said member is elongated and its upper side is provided with one or more through borings 32 and said member is, together with clamping means (not shown), used to detachably attach said member to the work table 8. One end of said member 31 has further an elongated opening 33, the length of which can vary but preferably is so dimensioned, that it extends over two grooves 9 of the worktable 8. By arranging the member 31 at a suitable place on the worktable 8, the bracket 14 may be guided into the opening 33 whereafter the clamping element may be tightened as described above.

The application of the system according to the invention is many-sided and the system as a unit is flexible. The handling is easy and considerably less time consuming that hitherto known devices. The support may be so made that it telescopically can be displaced to any desired length and the chain correspondingly flexible adapted to various sizes of the workpiece.

To facilitate the use of the support a medium, for example air or oil, may be used whereby the telescopic parts can be raised by fluid pressure.

the preceding embodiments are illustrative of the practice of the invention. It is to be understood, however, that other expedients known to those skilled in the art or disclosed herein, may be employed without departing from the spirit of the invention or the scope of the appended claims.

I claim:

1. An assembly for releasably securing workpieces to a worktable comprising a worktable having at least one dovetail slot therein extending to one edge of said worktable, a yoke having a vertical threaded bore therethrough, a pressure element and a draw element, both elements being provided with means for coarse and fine adjustment, wherein said pressure element is a telescopic support arranged to rest on said worktable and to bear upwardly against said yoke resting upon said workpiece, wherein the draw element is flexible and consists of a link chain, the coarse adjustment means consisting of at least one bracket for engagement with at least one chain link, said bracket having means for engagement with said at least one dovetail slot of said worktable, and the fine adjustment means consisting of a member in which a threaded bar is rotatably attached, said threaded bar being mounted in said vertical threaded bore of said yoke, and wherein said bracket is provided with a first member for engagement with said dovetail slot of said worktable, said first member being integral with a second member having projections for engagement with links of said chain, said projections having dimensions and spacing corresponding to the dimensions and spacing of said links of said chain.

2. The assembly as claimed in claim 1, further comprising a part for co-operation with the worktable for receiving said bracket, said part having bores to receive clamping means to secure it to the worktable and an elongate opening in one end to receive said bracket.

3. The assembly as claimed in claim 1, wherein said means for coarse adjustment of said support consists of circumferential grooves arranged in a telescopic cylinder, said grooves engaging a series of locking balls, and wherein said means for fine adjustment of said support consists of an adjustment screw, fitted into an axial threaded bore in said cylinder, said adjustment screw being the part for bearing upwardly against said yoke, whereby the spacing in an axial direction of said grooves corresponds to the length of the tightening range of said screw.

* * * * *